United States Patent [19]

Brockway

[11] Patent Number: 5,044,134

[45] Date of Patent: Sep. 3, 1991

[54] RELOCATABLE MODULAR BUILDING WALL AND FLOOR SYSTEM

[76] Inventor: Wilhelm W. Brockway, 4503 Coolhaven Ct., Westlake Village, Calif. 91361

[21] Appl. No.: 316,932

[22] Filed: Feb. 27, 1989

[51] Int. Cl.[5] ..... E04N 1/00

[52] U.S. Cl. ..... 52/79.1; 52/79.9; 52/238.1

[58] Field of Search ..... 52/79.1, 79.9, 79.13, 52/292, 293, 35, 344, 238.1, 243, 363

[56] References Cited

U.S. PATENT DOCUMENTS

| | | | |
|---|---|---|---|
| 1,813,909 | 7/1931 | Brainard et al. . | |
| 2,138,958 | 12/1938 | Corbett et al. | 52/238.1 |
| 2,150,176 | 3/1939 | Levy . | |
| 2,706,313 | 4/1955 | Radman . | |
| 2,712,863 | 7/1955 | Busch . | |
| 3,256,652 | 6/1966 | Van Der Lely . | |
| 4,120,133 | 10/1928 | Rodgers et al. | 52/79.1 X |
| 4,145,851 | 3/1979 | Padleckas | 52/79.1 X |
| 4,269,006 | 5/1981 | Larrow | 52/79.1 |
| 4,470,227 | 9/1984 | Bigelow, Jr. et al. | 52/79.1 |
| 4,545,158 | 10/1985 | Rizk | 52/79.1 |

*Primary Examiner*—David A. Scherbel
*Assistant Examiner*—Creighton Smith
*Attorney, Agent, or Firm*—Kelly, Bauersfeld & Lowry

[57] ABSTRACT

A steel structural wall and floor system is provided for constructing either a modular relocatable building with a steel floor, or a permanent building on a concrete floor slab. Walls of the building include channel or tubular steel wall bases. The walls are anchored to a foundation by anchor bolts which engage the wall bases. Steel floor sections are attached by bolts to the walls rather than to the foundation. Angle iron bracings and steel plates are utilized to ensure a stable connection between the floor sections and the walls. A completed relocatable structure can be removed from the foundation by removing the anchor bolts using access provided by cutouts in the tubular wall bases. The walls can then be relocated while the floor sections remain attached thereto.

18 Claims, 3 Drawing Sheets

FIG. 5
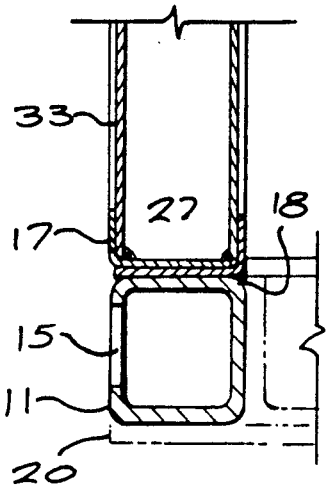
FIG. 6
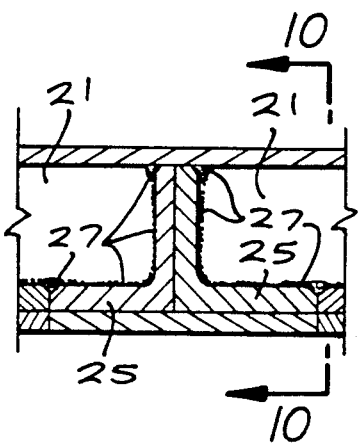
FIG. 7
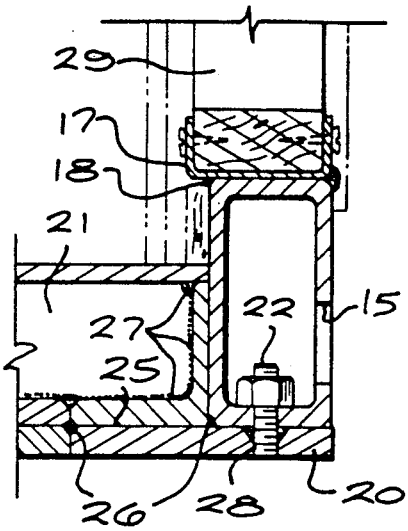
FIG. 8
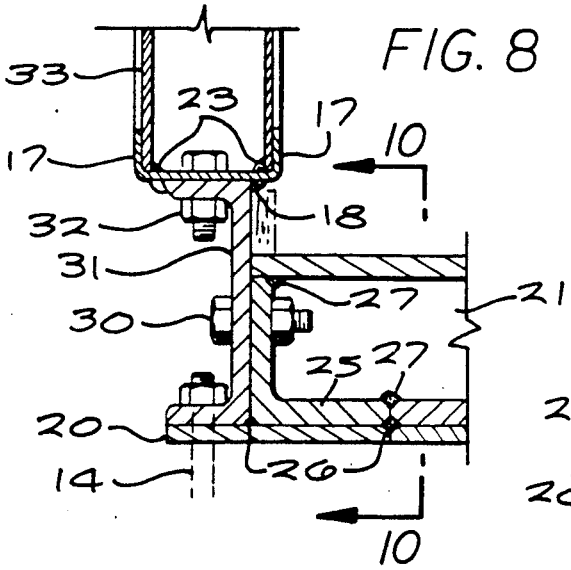
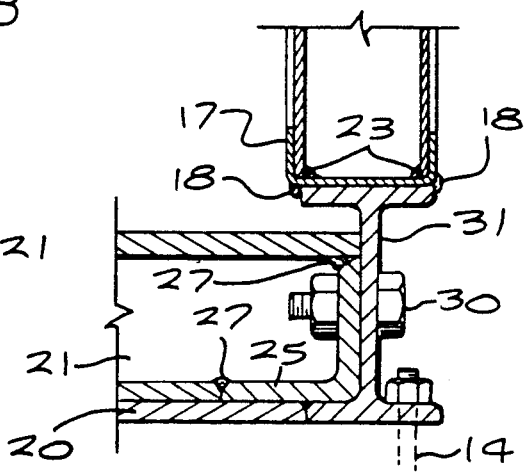
FIG. 9
FIG. 10
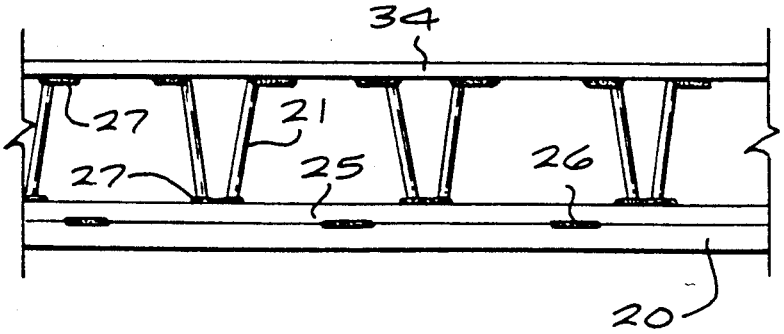

RELOCATABLE MODULAR BUILDING WALL AND FLOOR SYSTEM

BACKGROUND OF THE INVENTION

This invention relates generally to a relocatable modular building system with wall and floor sections that may be prefabricated off-site and quickly assembled on-site in a relatively easy manner. More particularly, this invention relates to a modular building system in which walls are anchored directly to a foundation, and then a floor is attached to the walls such that the walls and the floor can be relocated as a unit. This arrangement is in direct contrast to conventional building systems wherein the walls are attached to the floor which, in turn, is attached to the foundation.

Prior building systems comprise the conventional "stick built" structures which include a housing framework assembled on-site and erected onto a foundation prior to the assembly of wiring, plumbing, etc., into the walls. A drawback of "stick built" construction is that much time is lost in assembling the building components on-site when the same parts could be assembled more efficiently elsewhere.

The advent of prefabricated building systems has reduced building costs and increased efficiency in many types of building construction. In one type of well known modular building system, the walls of the prefabricated buildings are typically pre-manufactured in a factory with the wiring, plumbing and insulation already installed. The pre-assembled components are then trucked to the building site having been previously prepared for efficient installation. Another well known modular building system includes mobile classrooms and mobile homes which are built at a factory and then transported to the final destination after being substantially completely constructed.

A common characteristic of both "stick built" and prefabricated methods of construction is that the resultant structure either utilizes a floor attached to the foundation, or walls that are not relocatable while attached to the floor. Moreover, in order to meet building codes and avoid moisture or termite problems, prior modular building systems used for classroom trailers require the spacing of wooden floor structures at least one foot above ground level, thus disadvantageously requiring the use of jacks or blocks beneath the structure.

There exists, therefore, a significant need for a modular building system having the floor attached to the walls rather than to the foundation, thereby enabling a structure to be built with wall and floor sections that are relocatable or removable in a relatively easy fashion. Moreover, such a building system should preferably utilize structural components which can be manufactured off-site, moved to the building site, and then quickly and efficiently assembled. Such a system advantageously permits the components of the structure to be manufactured in a highly controlled, assembly line fashion. Additionally, a relocatable modular building system is needed which utilizes a metal floor that is impervious to water so that the floor can be located adjacent the ground and the need for jacks or blocks is eliminated. The present invention fulfills these needs and provides further related advantages.

SUMMARY OF THE INVENTION

The present invention resides in an improved modular building system having structural walls removably attached to a foundation, and floor sections connected to the walls rather than to the foundation. The modular building system provides for relatively fast and efficient assembly of a structure having wall and floor sections that can advantageously be relocated or removed in a relatively easy fashion which does not require detachment of the floor sections from the walls. Alternatively, the present invention can be used in conjunction with a concrete floor system.

The modular building system of the present invention utilizes structural components that are prefabricated off-site so that on-site assembly of the structure can be accomplished relatively quickly and efficiently, thereby lowering labor costs. The present invention beneficially includes a relocatable steel floor that eliminates termite and moisture problems, and the resultant need for jacks or blocks beneath the structure. Moreover, the versatile system of the present invention provides excellent flexibility for reconfiguring a modular structure to meet changing needs, because a relatively easy rearrangement of the walls can reapportion the interior space of the structure into a different layout of modules.

In a preferred form of the present invention, structural walls are prefabricated off-site with a tubular or channel-like base attached beneath an upwardly extending channel having studs welded thereto. Plywood or metal sheathing is added to the studs off-site. Floor sections are also prefabricated off-site and generally comprise a corrugated steel section framed by angle iron bracings around its edges and covered by a plywood or metal floor deck.

The bases of the walls are removably attached to the foundation by anchor bolts. In the tubular bases, access to the anchor bolts is provided by cutouts covered by removable plates. An advantage of the invention is that an anchor bolt access for removing and relocating the walls is available from the exterior of the structure with both the tubular and channel-like bases.

Long, continuous steel plates providing a moisture and termite resistant barrier are positioned between the foundation and the walls when a relocatable steel floor is used in lieu of a concrete floor system. In select locations, the anchor bolts extend upwardly through the steel plates to bolt the wall sections to the foundation. Shorter steel plates are positioned to lie beneath abutting floor sections. The steel plates provide means for connecting the floor sections to the walls. Bolts welded to the steel plates are used to secure the steel plates to the wall bases at locations where an anchor bolt is also available. The connection is completed by welding the angle iron bracings of each floor section to the steel plates.

Alternatively, the angle iron bracings may be bolted to the wall bases. In this arrangement, use of the channel-like wall bases is preferred.

In accordance with a preferred method of the invention, the floor sections are positioned upon the steel plates, or alternatively upon a concrete slab. Next, the bases of the walls are secured to the foundation by anchor bolts which can engage the steel plates as well. The steel plates may be bolted to the wall bases at locations preferably adjacent to the anchor bolts by using upwardly extending bolts welded to the plates. Finally, the floor sections are attached to the walls by bolting the angle iron bracings to the wall bases or by welding the bracings to the steel plates.

The walls are relocated by simply unbolting the anchor bolts. Because the floor is attached to the walls, rather than to the foundation, the wall and floor sections are advantageously relocated as a unit. The wall sections are positioned in a new arrangement atop the foundation, or are moved to an entirely different foundation, and then are reattached in place by the anchor bolts.

A more permanent building can be erected using the present invention with the inclusion of a concrete slab. In one embodiment, the metal floor sections can sit atop the slab, in which case the walls and their attached floor sections remain relocatable as a unit. Alternatively, the concrete slab can be used as the floor, in which case only the detachable walls are relocatable.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 5 is a fragmented cross-sectional view of the steel tube wall base attached to a structural steel wall framing;

FIG. 6 is a fragmented, cross-sectional view of modular floor sections joined at modular bracing connections;

FIG. 7 is a fragmented cross-sectional view of a steel tube wall base sized to provide a higher wall elevation from the foundation;

FIG. 8 is a fragmented elevational view, partly in cross-section, of a steel channel used as a structural wall base;

FIG. 9 is a fragmented elevational view, partly in cross-section, of a steel beam used as a structural wall base;

FIG. 10 is an exemplary cross-sectional view through the steel floor system, taken generally along the line 10—10 of FIGS. 2-4, 6 and 8;

DETAILED DESCRIPTION OF THE PREFERRED EMBODIMENTS

Figure 1:
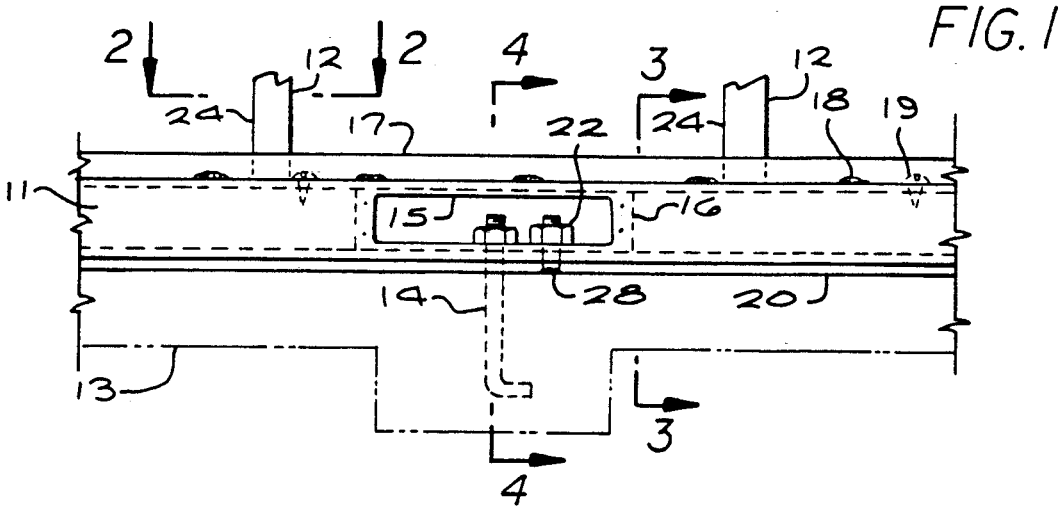
FIG. 1 is a fragmented, front elevational view of a steel tube which is used as a base of a structural wall and is secured to a foundation with anchor bolts.
Figure 2:
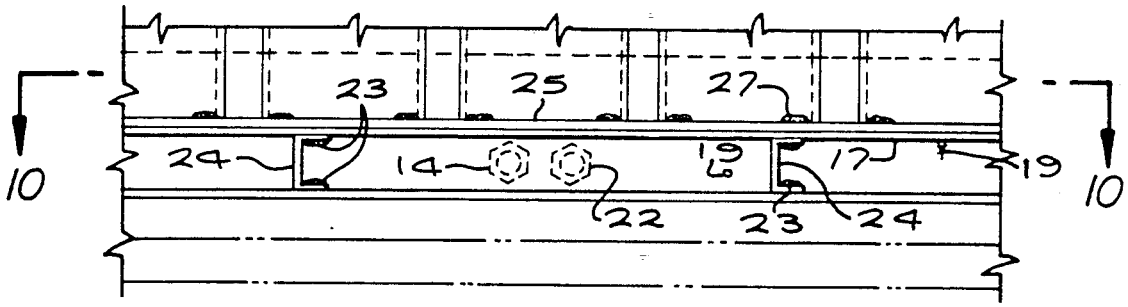
FIG. 2 is a top plan view of the steel tube base of the structural wall, taken generally along line 2—2 of FIG. 1.
Figure 3:
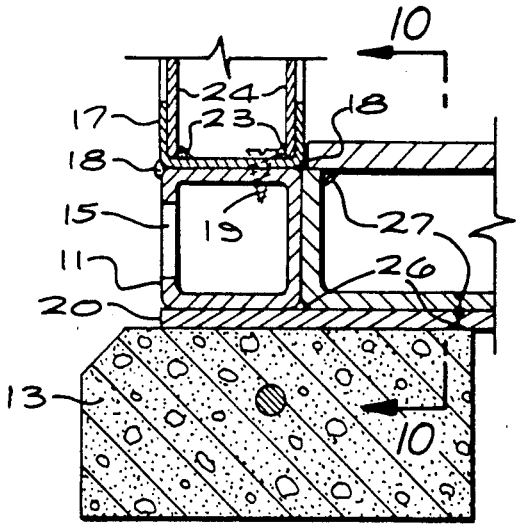
FIG. 3 is a cross-sectional view taken generally on line 3—3 of FIG. 1, illustrating the steel tube structural wall base, the foundation, and a steel floor attached to the wall base.

As shown in the drawings for purposes of illustration, the present invention resides in a modular building system having structural walls attached to a foundation, and floor sections connected to the walls rather than the foundation. The invention advantageously enables the walls and the floor sections attached thereto to be relocated or removed as a unit in a relatively easy fashion. In addition, the versatile modular building system, normally featuring a relocatable steel floor, can be used instead with a concrete floor system for more permanent buildings.

Figure 4:
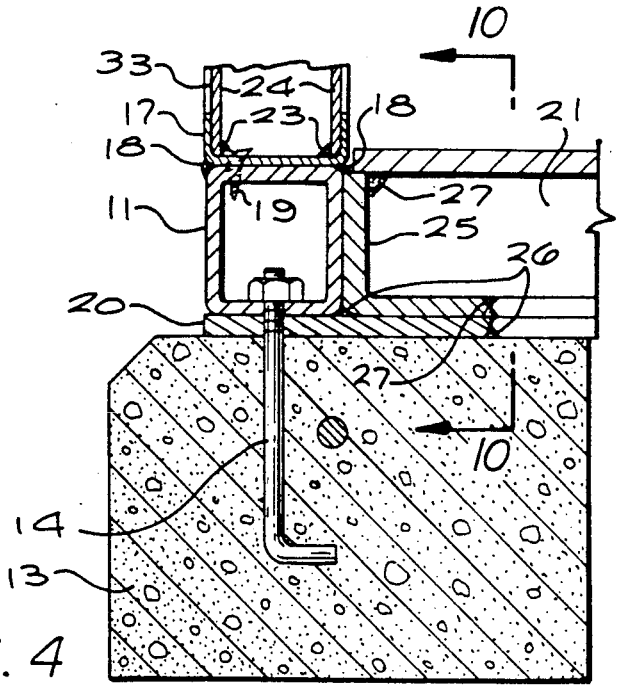
FIG. 4 is a fragmented, cross-sectional view taken generally on line 4—4 of FIG. 1, illustrating the structural wall secured to the foundation by an anchor bolt attaching the steel tube base of the wall to the foundation.

In accordance with the present invention and with reference to FIG. 1, tubular wall bases 11 of structural walls 12 are secured to a foundation 13 with anchor bolts 14 located a maximum of ten feet on centers or per building code requirements. Access to the anchor bolts 14 is provided from outside the structure by cutouts 15 in the wall bases 11. Each cutout 15 is covered with a metal plate 16. The anchor bolts 14 can be of the red head or "J" bolt variety. Preferably, the anchor bolts are bent at their lower ends (FIG. 4) to augment the embedment of the anchor bolts within the foundation.

Each structural wall 12 has a bottom channel 17 which is welded along weld lines 18 or secured with self tapping screws 19 to the wall base 11. The bottom channel 17 is welded at weld locations 23 to steel studs 24. An exterior surface for the walls 12 is provided by plywood or metal sheathing attached to the outside of the steel studs 24 by self tapping screws. The interior of the walls 12 can be factory prefabricated with wiring, plumbing, interior finishing, cabinets, etc., installed off-site to substantially reduce on-site assembly requirements. Alternatively, the walls 12 can be shipped to the site with unfinished interiors having the wiring, plumbing, etc., omitted. This practice advantageously provides flexibility in that an on-site architect can specify insulation, sound proofing and other interior finishing designed to meet the particular thermal or acoustical, concerns associated with the environment in which the structure is to be erected. In all cases, the wall bases 11, bottom channels 17, steel studs 24 and exterior sheathing 33 are preassembled off-site.

Steel plates 20 situated between each wall base 11 and the foundation 13 are used to secure a formed steel floor system of floor sections 21 (FIG. 7), to the structural wall bases 11 by means of bolts 22 welded to the steel plates where indicated by the reference numeral 28. The steel plates 20 are also secured to the wall base 11 and to the foundation 13 by the anchor bolts 14. The steel plates 20 are provided in two sizes. Long continuous plates (FIG. 1) are positioned atop the foundation wherever outer walls are to be erected, and shorter plates (FIG. 6) are located to underlie abutting floor sections. The steel plates and steel floor sections beneficially stop termites and water leakage so that the floor can rest on steel plates directly atop the ground. In an alternative embodiment of the invention utilizing a concrete floor slab, the steel plates 20 are omitted.

The modular floor and wall sections are sized to be approximately 30, 32, 36 or 40 feet long and 10 or 12 feet wide. A select number of wall sections include doors and/or windows. For added stability, ends of the floor sections 21 are welded to angle iron bracings 25 at the weld locations 27. The angle iron bracings 25 are also welded to the steel plates 20 at the weld locations 26.

As an alternative to the tube-like wall base 11 illustrated in FIG. 5, a larger sized wall base 11 (FIG. 7) can be used in order to provide a higher wall elevation from the foundation. The structural walls 12 can comprise wooden wall studs 29 (FIG. 7) where approved by area building codes.

As illustrated in FIG. 8, the floor system 21 can be secured by the bolts 30 to yet another alternative to the tube-like wall base 11; namely a steel channel wall base 31. With use of the channel wall base 31, the walls 12 may be attached thereto by bolts 32 and/or welding at the weld lines 18. The configuration of the channel wall base 31 also provides easy access to the anchor bolts 14 from outside the structure, as well as access to the bolts 30 and 32.

Figure 11:
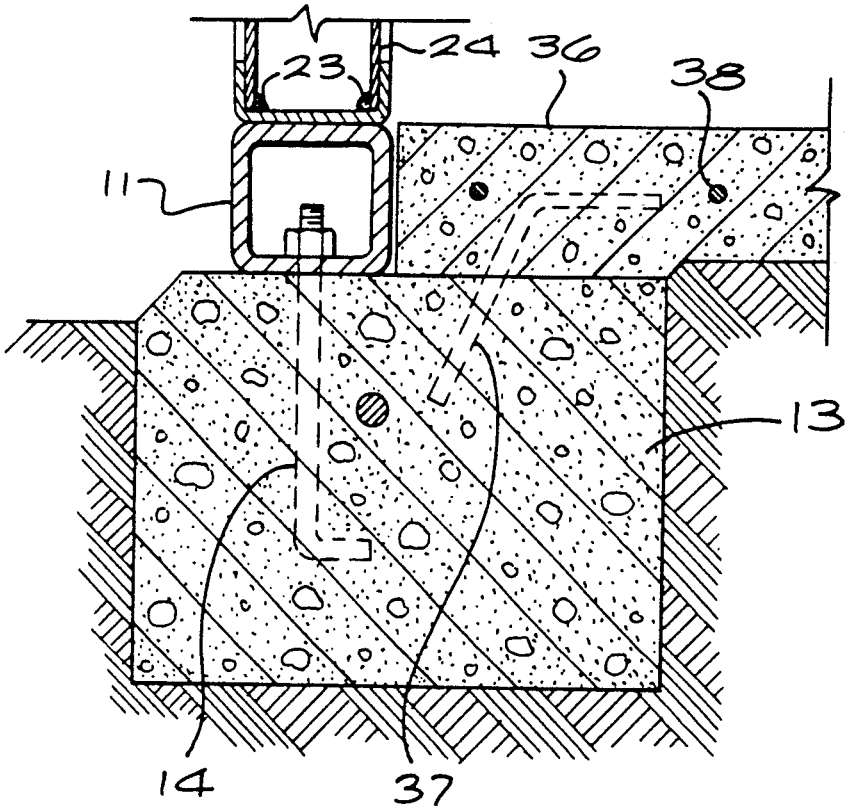
FIG. 11 is a fragmented, cross-sectional view of the structural wall installed in conjunction with a concrete floor system.
Figure 12:
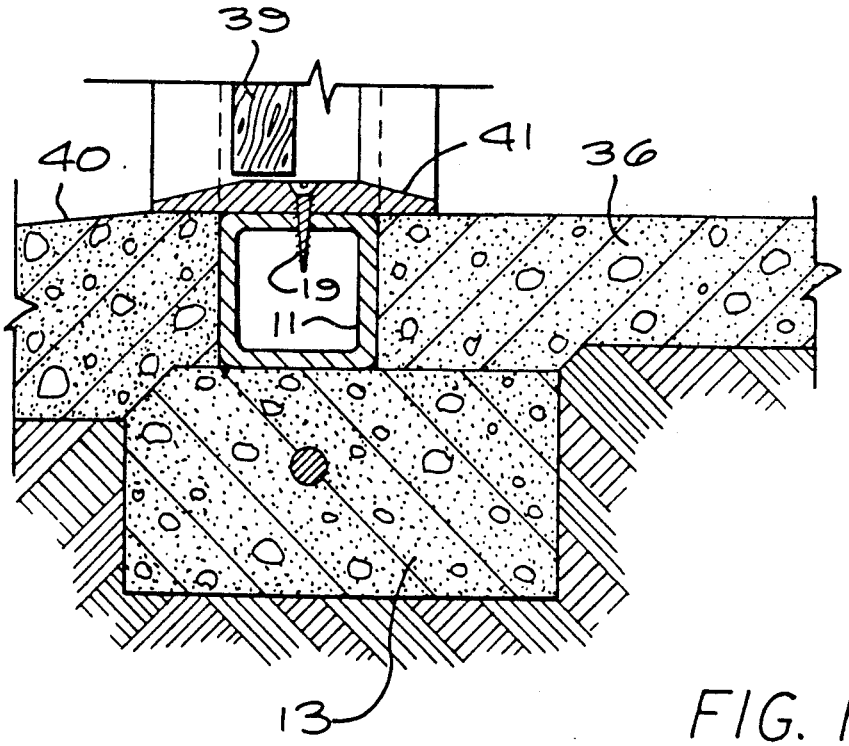
FIG. 12 is a fragmented, cross-sectional view of door location in a system utilizing the concrete floor system.

The formed steel floor system is shown in cross-section in FIG. 10 to illustrate the weld locations 27 connecting the floor sections 21 to the angle iron bracings 25. Atop each floor section 21, a treated or termite proof wooden floor deck 34 is secured by conventional means. A light gauge steel sheet, spot welded to the steel floor sections 21, may be used in place of the wooden floor deck 34. The floor deck 34 is preattached off-site and need not be removed during relocation of the floor. Alternatively, a concrete floor system can be used in place of the steel floor system in order to provide a more permanent building. A concrete floor slab 36 (FIGS. 11–12) and the foundation 13 are laid in a conventional manner, with steel reinforcing rods 37 affixing the slab to the foundation, and a standard steel web system 38 reinforcing the slab. The concrete floor slab 36 will abut the wall bases 11 in the same manner as a floor section 21, except that the steel plates 20 are omitted as unnecessary. At locations where a door and door frame unit 39 (FIG. 12) is included within a wall section, the concrete floor slab 36 will extend to abut a door threshold 41 which is attached to the wall base 11 by self-tapping screws 19. A concrete ramp 40 is provided adjacent each threshold 41. The concrete floor slab 36 can be used as the floor structure or floor sections 21 can be laid upon it. In the former case, only the walls 12 will be relocatable.

The aforementioned wall and floor sections of the modular building system may be prefabricated under controlled conditions and in an assembly line fashion. These components are then trucked to the construction site and erected onto the foundation 13 in the manner now to be described. First, the steel plates 20 are positioned atop the foundation 13 at locations where outer structural walls 12 are to be attached. Shorter steel plates are located wherever floor sections are to abut. With a concrete slab, the use of the steel plates is omitted. The anchor bolts 14 preferably are embedded within the foundation. The steel plates 20 contain holes through which the anchor bolts will extend once the steel plates are in place.

Next, the floor sections 21 are laid in place, either upon the concrete slab 36 or upon the steel plates 20. Alternatively, the steel plates 20 can be pre-welded to the underside of the floor sections 21 and both components can be laid down as a unit. When the concrete slab 36 is to serve as a floor, this and subsequent steps involving the floor sections are omitted.

The structural walls 12 are then positioned such that the wall bases 11 abut either the floor sections 21 or the concrete floor slab 36, depending upon the type of floor being used. This positioning step involves aligning and engaging holes in the wall bases 11 with the anchor bolts 14 and with the bolts 22 (FIG. 7) connected to the steel plates. Nuts are then threaded onto the anchor bolts 14 and the bolts 22 to secure the structural walls in place with the wall bases 11 bolted directly to the foundation 13.

Following erection of the walls, the floor sections 21 (when used) are attached to the wall bases 11 using one of the following methods. The angle iron bracings 25 of the floor sections 21 can be welded to the steel plates 20 at weld locations 26 adjacent the wall bases 11. Alternatively, the angle iron bracings 25 can be bolted by the bolts 30 to the wall bases 11, whether the wall bases 11 are configured as a tube (FIG. 5), an enlarged tube (FIG. 7), a channel (FIG. 8) or an I-beam (FIG. 9). The angle iron bracings 25 can also be both bolted and welded to the wall bases 11 and/or the steel plates 20.

After all wall and floor sections are assembled into a modular structure, a roof of formed sheet steel with a structural steel frame can be bolted to a top plate of the structural walls. Alternatively, the roof can be installed in any suitable conventional manner.

The wall sections 12 are relocated by unbolting the anchor bolts 14 using access provided by the cutouts 15. The floor sections 21 readily relocate with the wall sections 12 as units because the floor is attached thereto, rather than to the foundation 13. Once the detached, movable wall sections 12 have been relocated to new positions, the wall sections 12 are bolted again to the foundation 13 by the anchor bolts 14. This feature advantageously allows portable modular buildings to be constructed.

From the foregoing, it will be appreciated that the improved modular building system of the present invention advantageously enables the walls to be relocated while the floor remains attached thereto. Further, the present invention can be quickly and easily assembled at the construction site with premanufactured components that reduce on-site construction time and labor costs. Moreover, the present invention is ideal for constructing modular classrooms because the water and termite resistant steel floor system obviates any need to elevate the structure above ground with jacks or blocks, and the relocatable walls may be reapportioned or reconfigured to meet the changing demands of a school.

Although a particular embodiment of the invention has been described in detail for purposes of illustration, various modifications may be made without departing from the spirit and scope of the invention. Accordingly, the invention is not to be limited, except as by the appended claims.

I claim:

1. A modular building system, the steps comprising:
providing a foundation;
providing first metal plates positioned atop the foundation at locations where modular wall sections are to be erected;
providing modular wall sections positioned atop the first metal plates;
removably attaching the wall- sections directly to the foundation using anchor bolts which extend through the first metal plates;
providing modular floor sections; and
attaching the floor sections to the wall sections, wherein the wall sections can be detached from the foundation and relocated while the floor sections remain attached thereto.

2. A modular building system as set forth in claim 1, further including the step of providing second metal plates positioned atop the foundation at locations where two floor sections will abut, prior to attaching the floor sections to the wall sections.

3. A modular building system as set forth in claim 1, wherein the step of providing the floor sections includes attaching angle iron bracings to ends of the floor sections, and wherein the step of attaching the floor sections to the wall sections includes bolting the angle iron bracings to the wall sections.

4. A modular building system as set forth in claim 1, wherein the step of providing the floor sections includes attaching angle bracings to ends of the floor sections, and wherein the step of attaching the floor sections to the wall sections includes welding the angle bracings to the first metal plates.

5. A modular building system as set forth in claim 1, further including the steps of detaching the wall sections from the foundation, relocating the wall sections while the floor sections remain attached thereto, and reattaching the wall sections to the foundation in a new configuration.

6. A modular building system as set forth in claim 1, wherein the modular wall sections include means for permitting access to the anchor bolts.

7. A modular building method, the steps comprising:

providing a foundation for a modular building, the foundation including a slab having upwardly extending anchor bolts generally positioned where walls ar to be located;

placing modular wall sections onto the slab and over the anchor bolts;

attaching the wall sections to the foundation utilizing the anchor bolts, wherein access to the anchor bolts is provided form outside the modular building by cutouts in the wall sections, wherein the wall sections can be detached from the foundation and relocated; and attaching modular floor sections to the wall sections such that the modular floor section lie adjacent to the foundation and may be moved and relocated with the wall sections.

8. A modular building method as set forth in claim 7, further including the step of attaching the modular floor sections to the slab.

9. A relocatable modular building, comprising:

a foundation providing spaced, upwardly extending anchor bolts;

at least one modular wall section having a base secured to the foundation by the anchor bolts, wherein the base includes means for permitting access to the anchor bolts from outside the relocatable modular building; and at least one modular floor section attached to the wall section, wherein a wall section can be detached from the foundation and relocated as a unit with the floor section.

10. A modular building system as set forth in claim 9, wherein the base for the at least one modular wall section includes removable plates which cover the anchor bolt access means, to permit access to the anchor bolts.

11. A modular building system as set forth in claim 9, wherein the at least one modular floor section is bolted to the wall section.

12. A modular building system as set forth in claim 11, wherein the at least one modular floor section is further bolted directly to the foundation.

13. A modular building system as set forth in claim 9, wherein the floor section is comprised of corrugated metal with angle iron bracings attached along edges and a floor deck attached atop the floor section.

14. A modular building system as set forth in claim 9, wherein the at lest one modular wall section further includes a bottom channel attached atop the base, the bottom channel having upwardly extending sides with studs connected at intervals to the sides, wherein sheathing is attached to the studs in a manner forming an exterior surface of the at least one modular wall section.

15. A modular building system as set forth in claim 9, including an angle iron bracing for attaching the at least one modular floor section to the at least one modular wall section.

16. A modular building system as set forth in claim 15, including a first metal plate provided between the foundation and the at least one modular wall section, and second metal plate provided between the foundation and the at least one modular floor section at locations where adjacent floor sections abut, wherein at least one of the anchor bolts passes through the first metal plate.

17. A modular building system as set forth in claim 16, wherein the angle iron bracing attaching the at least one modular floor section to the at least one modular wall section is welded to the first metal plate.

18. A modular building system as set forth in claim 9, wherein the foundation includes a concrete slab, wherein the anchor bolts extend upwardly through the slab, and wherein the at least one modular floor section lies generally adjacent to the slab.

* * * * *

UNITED STATES PATENT AND TRADEMARK OFFICE

CERTIFICATE OF CORRECTION

PATENT NO. : 5,044,134

DATED : September 3, 1991

INVENTOR(S) : Wilhelm W. Brockway

It is certified that error appears in the above-identified patent and that said Letters Patent is hereby corrected as shown below:

In column 3, line 61, insert "a" between the words "of" and "door".

In column 6, line 54, delete "wall-sections" and insert therefor --wall sections--.

In column 7, line 25, delete "ar" and insert therefor --are--.

In column 7, line 30, delete "form" and insert therefor --from--.

In column 7, line 35, delete "section" and insert therefor --sections--.

Signed and Sealed this

Twelfth Day of January, 1993

*Attest:*

DOUGLAS B. COMER

*Attesting Officer*

*Acting Commissioner of Patents and Trademarks*